US005273111A

United States Patent [19]

Brannan et al.

[11] Patent Number: 5,273,111

[45] Date of Patent: Dec. 28, 1993

[54] LATERALLY AND VERTICALLY STAGGERED HORIZONTAL WELL HYDROCARBON RECOVERY METHOD

[75] Inventors: Geryl O. Brannan; William J. McCaffrey, both of Calgary, Canada

[73] Assignee: Amoco Corporation, Chicago, Ill.

[21] Appl. No.: 907,147

[22] Filed: Jul. 1, 1992

[51] Int. Cl.[5] ..... E21B 43/24; E21B 43/30

[52] U.S. Cl. ..... 166/245; 166/50; 166/263; 166/272

[58] Field of Search ..... 166/50, 245, 263, 272

[56] References Cited

U.S. PATENT DOCUMENTS

| | | | |
|---|---|---|---|
| 3,960,213 | 6/1976 | Striegler et al. | 166/272 |
| 3,960,214 | 6/1976 | Striegler et al. | 166/272 |
| 4,007,788 | 2/1977 | Striegler et al. | 166/272 |
| 4,037,658 | 7/1977 | Anderson | 166/272 |
| 4,062,404 | 12/1977 | Pasini et al. | 166/259 |
| 4,101,172 | 7/1978 | Rabbitts | 299/2 |
| 4,153,300 | 5/1979 | Kvapil et al. | 299/2 |
| 4,160,481 | 7/1979 | Turk et al. | 166/272 |
| 4,162,808 | 7/1979 | Kvapil et al. | 299/2 |
| 4,165,903 | 8/1979 | Cobbs | 299/2 |
| 4,227,743 | 10/1980 | Ruzin et al. | 299/2 |
| 4,257,650 | 3/1981 | Allen | 299/2 |
| 4,265,485 | 5/1981 | Boxerman et al. | 166/272 X |
| 4,296,969 | 10/1981 | Willman | 299/2 |
| 4,344,485 | 8/1982 | Butler | 166/50 X |
| 4,368,781 | 1/1983 | Anderson | 166/252 |
| 4,384,613 | 5/1983 | Owen et al. | 166/256 |
| 4,385,662 | 5/1983 | Mullins et al. | 166/263 |
| 4,390,067 | 6/1983 | Willman | 166/245 |
| 4,410,216 | 10/1983 | Allen | 166/245 X |
| 4,456,065 | 6/1984 | Helm et al. | 166/248 |
| 4,456,066 | 6/1984 | Shu | 166/272 |
| 4,460,044 | 7/1984 | Porter | 166/252 |
| 4,463,988 | 8/1984 | Bouck et al. | 299/2 |
| 4,480,695 | 11/1984 | Anderson | 166/303 |
| 4,489,782 | 12/1984 | Perkins | 166/248 |
| 4,508,172 | 4/1985 | Mims et al. | 166/303 |
| 4,510,997 | 4/1985 | Fitch et al. | 166/263 |
| 4,511,000 | 4/1985 | Mims | 166/303 |
| 4,522,260 | 6/1985 | Wolcott, Jr. | 166/245 |
| 4,532,986 | 8/1985 | Mims et al. | 166/50 |
| 4,532,994 | 8/1985 | Toma et al. | 166/303 |
| 4,535,845 | 8/1985 | Brown et al. | 166/272 |
| 4,565,245 | 1/1986 | Mims et al. | 166/50 |
| 4,577,691 | 3/1986 | Huang et al. | 166/263 |
| 4,598,770 | 7/1986 | Shu et al. | 166/245 |
| 4,633,948 | 1/1987 | Closmann | 166/271 |

(List continued on next page.)

OTHER PUBLICATIONS

S. D. Joshi, "A Review of Thermal Oil Recovery Using Horizontal Wells", *In Situ*, 11(2&3), pp. 211-259 (1987).

Helen L. Chang, S. M. Farouq Ali and A. E. George, "Performance of Horizontal-Vertical Well Combinations for Steamflooding Bottom Water Formations", preprint of Paper No. CIM/SPE 90-86, Petroleum Society of CIM/Society of Petroleum Engineers (Jun. 10-13, 1990).

R. M. Butler and D. J. Stephens, "The Gravity Drain- (List continued on next page.)

*Primary Examiner*—George A. Suchfield

*Attorney, Agent, or Firm*—James A. Gabala; Richard A. Kretchmer; Frank J. Sroka

[57] ABSTRACT

A method which combines fluid drive and gravity drainage to produce hydrocarbons from a subterranean formation comprises injecting a fluid through at least two upper horizontal wells out into the formation for moving hydrocarbons from the formation into at least one lower horizontal well through which the hydrocarbons are produced, wherein each lower horizontal well is spaced laterally and vertically below and between two respective upper horizontal wells; and producing hydrocarbons through the at least one lower horizontal well at a cumulative rate faster than the cumulative rate of the fluid injected into the upper horizontal wells. The method further comprises injecting a fluid and producing hydrocarbons as just described but with additional upper and lower horizontal wells longitudinally spaced from the first-mentioned upper and lower horizontal wells so that each of the lower horizontal wells operates as a discrete production well.

17 Claims, 9 Drawing Sheets

U.S. PATENT DOCUMENTS

| | | | |
|---|---|---|---|
| 4,640,359 | 2/1987 | Livesey et al. | 166/276 |
| 4,645,003 | 2/1987 | Huang et al. | 166/245 |
| 4,646,824 | 3/1987 | Huang et al. | 166/52 |
| 4,653,583 | 3/1987 | Huang et al. | 166/252 |
| 4,662,441 | 5/1987 | Huang et al. | 166/245 |
| 4,696,345 | 9/1987 | Hsueh | 166/245 |
| 4,700,779 | 10/1987 | Huang et al. | 166/263 |
| 4,702,314 | 10/1987 | Huang et al. | 166/245 |
| 4,794,987 | 1/1989 | Kokolis et al. | 166/274 |
| 4,834,179 | 5/1989 | Kokolis et al. | 166/268 |
| 4,850,429 | 7/1989 | Mims et al. | 166/50 X |
| 5,033,546 | 7/1991 | Combe | 166/272 X |
| 5,046,559 | 9/1991 | Glandt | 166/50 X |

OTHER PUBLICATIONS age of Steam-Heated Heavy Oil to Parallel Horizontal Wells", *Journal of Canadian Petroleum*, pp. 90-96, (Apr.-Jun., 1981).

R. M. Butler, "rise of Interfering Steam Chambers", *The Journal of Canadian Petroleum Technology*, pp. 70-75, vol. 26, No. 3 (1986).

F. R. Scott Ferguson and R. M. Butler, "Steam-Assisted Gravity Drainage Model Incorporating Energy Recovery from a Cooling Steam Chamber", *the Journal of Canadian Petroleum Technology*, pp. 75-83, vol. 27, No. 5 (Sep.-Oct. 1988).

R. M. Butler and G. Petela, "Theoretical Estimation of Breakthrough Time and Instantaneous Shape of Steam Front During Vertical Steamflooding", *AOSTRA Journal of Research*, pp. 359-381, vol. 5, No. 4 (1989).

P. J. Griffin and P. N. Trofimenkoff, "Laboratory Studies of the Steam-Assisted Gravity Drainage Process", presented at the fifth annual "Advances in Petroleum Recovery & Upgrading Technology" Conference, Jun. 14-15, 1984, Calgary, Alberta, Canada (session 1, paper 1).

S. D. Joshi and C. B. Threlkeld, "Laboratory Studies of Thermally Aided Gravity Drainage Using Horizontal Wells", *AOSTRA Journal of Research*, vol. 2, No. 1 (1985).

H. G. Stephenson, "Exploitation of Shallow Oil Sands Beyond Surface Mining Limits", CIM Fourth District No. 5 Meeting, (Oct. 25-27, 1989).

P. F. Ahner and A. H. Sufi, "Physical Model Steamflood Studies Using Horizontal Wells", SPE/DOE 20247 (1990).

Francois M. Giger, "Analytic Two-Dimensional Models of Water Cresting Before Breakthrough for Horizontal Wells", *SPE Reservoir Engineering*, pp. 409-416, vol. 4, No. 4, (Nov. 1989).

H. J.-M. Petit, G. Renard and E. Valentin, "Technical and Economic Evaluation of Steam Injection with Horizontal Wells for Two Typical Heavy-Oil Reservoirs" SPE 19828 (Oct. 1989).

B. I. Nzekwu, "Critical Review of the Application of Horizontal Wells", *Petroleum Society of CIM*, presented at the third technical meeting of the South Saskatchewan Section, The Petroleum Society of CIM, held in Regina, Sep. 25-27, 1989.

M. L. Proctor, A. E. George, and S. M. Fraouq Ali, "Steam Injection Strategies for Thin Bottomwater Reservoirs", SPE 16338 (Apr. 1987).

P. Toma, D. Redford, and D. Livesey, "The Laboratory Simulation of Bitumen Recovery by Steam Stimulation of Horizontal Wells", presented at the 1984 WRI-DOE TAR-SAND Symposium in Vail, Colorado, Jun. 26-29, 1984.

H. H. A. Huygen and J. B. Black, "Steaming Through Horizontal Wells and Fractures Scaled Model Tests", presented at the Second European Symposium on Enhanced Oil Recovery, held in Paris, Nov. 8-10, 1982.

P. Toma, V. Reitman, R. M. Coates, T. Heidrick, and R. K. Ridley, "Comparison of HASDrive and Sand-Filled Multiple Communications Steam Recovery Processes for Heavy and Extra-Heavy Oil Reservoirs", SPE 18788, (Apr., 1989).

Roger M. Butler, "The Potential for Horizontal Wells for Petroleum Production", *Journal of Canadian Petroleum Technology*, pp. 39-47, vol. 28, No. 3 (May-Jun. 1989).

L. W. Holm, "A Comparison of Propane and Carbon Dioxide Solvent Flooding Processes", *A.I.Ch.E. Journal*, pp. 179-184, vol. 7, No. 2 (1961).

L. W. Holm, "$CO_2$ Flooding: Its Time Has Come", *Journal of Petroleum Technology*, pp. 2739-2745, (Dec. 1982).

T. G. Harding, S. M. Farouq Ali and D. L. Flock, "Steamflood Performance in the Presence of Carbon Dioxide and Nitrogen", *Journal of Canadian Petroleum Technology*, pp. 30-37 (Sep.-Oct. 1983).

LATERALLY AND VERTICALLY STAGGERED HORIZONTAL WELL HYDROCARBON RECOVERY METHOD

BACKGROUND OF THE INVENTION

This invention relates generally to methods for recovering hydrocarbons from a subterranean formation. In a particular aspect, the method of the present invention utilizes separate, discrete horizontal injection and production wells which are laterally and vertically spaced from each other and which are used to produce hydrocarbons from the lower horizontal wells at a rate faster than a driving fluid is injected into the upper horizontal wells. It is contemplated that the method of the present invention can be used to deplete a formation containing heavy, viscous oil, for example, more economically than other previously proposed recovery techniques.

Hydrocarbons, such as petroleum, cannot always be economically recovered from a subterranean formation using only the natural energy within the formation or the energy provided by pumping or some other primary means of production. For example, heavy, viscous oil typically cannot be economically produced using only primary production techniques. Formations of such oil can be found at, for example, the Athabasca, Cold Lake and Tangleflags (Lloydminster) oil sands deposits in Canada. To more economically deplete such formations, a secondary production technique is needed.

One category of known secondary production techniques includes injecting a fluid (gas or liquid) into a formation through a vertical or horizontal injection well to drive hydrocarbons out through a vertical or horizontal production well. Steam is a particular fluid that has been used. Solvents and other fluids (e.g., water, carbon dioxide, nitrogen, propane and methane) have been used.

These fluids typically have been used in either a continuous injection and production process or a cyclic injection and production process. The injected fluid can provide a driving force to push hydrocarbons through the formation, and the injected fluid can enhance the mobility of the hydrocarbons (e.g., by reducing viscosity via heating) thereby facilitating the pushing of the more mobile hydrocarbons to a production location. Recent developments using horizontal wells have focused on utilizing gravity drainage to achieve better results. At some point in a process using separate injection and production wells, the injected fluid may migrate through the formation from the injection well to the production well.

Preferably, a secondary production technique used for injecting a selected fluid and for producing hydrocarbons maximizes production of the hydrocarbons with a minimum production of the injected fluid. See U.S. Pat. No. 4,368,781 to Anderson. Thus, early breakthrough of the injected fluid from an injection well to a production well and an excessive rate of production of the injected fluid have been disclosed as not being desirable. See Joshi, S. D. and Threlkeld, C. B., "Laboratory Studies of Thermally Aided Gravity Drainage Using Horizontal Wells," *AOSTRA J. of Research,* pages 11–19, vol. 2, no. 1 (1985). It has also been disclosed that optimum production from a horizontal production well is limited by the critical velocity of the fluid through the formation. This is to avoid "fingering" of the injected fluid through the formation. See U.S. Pat. No. 4,653,583 to Huang et al. There is a disclosure, however, that "fingering" is not critical in radial horizontal wells. See U.S. Pat. No. 4,257,650 to Allen.

The foregoing disclosures have been within contexts referring to various spatial arrangements of injection and production wells. The spatial arrangements of which we are aware can be classified as follows: vertical injection wells with vertical production wells, horizontal injection wells with horizontal production wells, and combinations of horizontal and vertical injection and production wells. Because the present invention described below relates to a method using separate, discrete horizontal injection and production wells, brief reference will be made herein only to the prior horizontal injection well with horizontal production well arrangements of which we are aware.

Parallel horizontal injection and production wells disposed in a horizontal planar array have been disclosed. See U.S. Pat. No. 4,700,779 to Huang et al., U.S. Pat. No. 4,385,662 to Mullins et al. and U.S. Pat. No. 4,510,997 to Fitch et al.

Parallel horizontal injection and production wells vertically aligned a few meters apart are disclosed in the aforementioned article by Joshi and Threlkeld. See also: Butler, R. M. and Stephens, D. J., "The gravity drainage of steam-heated heavy oil to parallel horizontal wells," *J. of Canadian Petroleum Technology,* pages 90–96 (April–June, 1981) Butler, R. M., "Rise of interfering steam chambers," *J. of Canadian Petroleum Technology,* pages 70–75, vol. 26, no. 3 (1986); Ferguson, F. R. S. and Butler, R. M., "Steam-assisted gravity drainage model incorporating energy recovery from a cooling steam chamber," *J. of Canadian Petroleum Technology,* pages 75–83, vol. 27, no. 5 (September–October, 1988); Butler, R. M. and Petela, G., "Theoretical Estimation of Breakthrough Time and Instantaneous Shape of Steam Front During Vertical Steamflooding," *AOSTRA J. of Research,* pages 359–381, vol. 5, no. 4 (fall 1989); and Griffin, P. J. and Trofimenkoff, P. N., "Laboratory Studies of the Steam-Assisted Gravity Drainage Process," presented at the fifth annual "Advances in Petroleum Recovery & Upgrading Technology" Conference, Jun. 14–15, 1984, Calgary, Alberta, Canada (session 1, paper 1). Vertically aligned horizontal wells are also disclosed in U.S. Pat. No. 4,577,691 to Huang et al., U.S. Pat. No. 4,633,948 to Closmann and U.S. Pat. No. 4,834,179 to Kokolis et al. This last cited patent discloses a spacing wherein a horizontal injection well is at or near the top of the swept reservoir and the one or more production wells, which may either be vertical or horizontal, are substantially below the horizontal injection well relatively near the bottom of the reservoir. This latter patent contemplates only gravity effects for a miscible fluid. This is an examples of a "falling curtain of solvent" method using gravity effects to move hydrocarbons below the "curtain."

Staggered horizontal injection and production wells, wherein the injection and production wells are both laterally and vertically spaced from each other, are disclosed in Joshi, S. D., "A Review of Thermal Oil Recovery Using Horizontal Wells," *In Situ,* 11(2&3), 211–259 (1987); Change, H. L., Farouq Ali, S. M. and George, A. E., "Performance of Horizontal-Vertical Well Combinations for Steamflooding Bottom Water Formations," preprint of paper no. CIM/SPE 90-86, Petroleum Society of CIM/Society of Petroleum Engineers; U.S. Pat. No. 4,598,770 to Shu et al.; and U.S. Pat. No. 4,522,260 to Wolcott, Jr.

At least some of these prior configurations of which we are aware provide limited sweep efficiency. That is, any one set of injection and production wells affects a relatively small volume of the formation. As a result, a relatively large number of wells need to be drilled to produce throughout an extensive formation. This is particularly applicable to the technique using closely spaced vertically aligned horizontal wells.

These prior configurations can also limit the forces available for producing hydrocarbons. For example, using the prior configuration of two horizontal wells vertically spaced from each other, one aligned below the other, steam is injected through the upper well and hydrocarbons are produced from the lower well; however, after a very short initial time period, the production occurs only in response to gravity draining the hydrocarbons which have been heated by the injected steam. The steam itself does not provide a significant driving force because there is at most only a small pressure differential between the two wells regardless of the flow rate of the injected steam. Conversely, in the prior configuration wherein the horizontal wells are horizontally aligned, only a fluid driving force is available because gravity drainage tends to move the hydrocarbons downward, rather than across to an adjacent well.

With regard to staggered horizontal injection and production wells, the aforementioned article by Joshi, although showing a lower injection well and an upper production well, states that having the injection well near the top of the reservoir results in a large heat loss to the overburden above the reservoir (see Joshi, *In Situ*, at 223). Note also that the Shu et al. (U.S. Pat. No. 4,598,770) discloses a vertical spacing where the injection well is closer to the lower production wells, which are located near the bottom of the reservoir, than to the top of the reservoir. The examples of the Shu et al. patent disclose a greater injection rate than production rate. The Wolcott, Jr. (U.S. Pat. No. 4,522,260) discloses that explosives are to be detonated to create a rubblized zone between the injection and production wells. This rubblizing adds cost to the overall production process and it produces an uncertainty in the process due to the uncertainty of what will result from the downhole explosion.

Although any of the aforementioned techniques will at least theoretically produce hydrocarbons, there is the need for an improved method which not only produces hydrocarbons, but also produces them at a relatively higher net revenue. That is, there is the need for a method of economically depleting a formation to maximize the difference between (1) the projected revenue from hydrocarbons, such as specifically oil, produced from the formation by the method, and (2) the projected cost of forming and operating wells in the formation through which to produce the hydrocarbons. Such a method preferably should be suited to producing hydrocarbons more economically from difficult deposits, such as the heavy oil sands of Athabasca, Cold Lake and Tangleflags (Lloydminster) in Canada.

SUMMARY OF THE INVENTION

:The present invention overcomes the abovenoted and other shortcomings of the prior art, and it meets the aforementioned needs, by providing a novel and improved method for recovering hydrocarbons from a subterranean formation. The method is a continuous process using a flow enhancing fluid in conjunction with upper horizontal injection wells staggered both horizontally and vertically above lower horizontal production wells to recover hydrocarbons from an underground hydrocarbon-bearing formation at a production rate which is greater than the rate at which the fluid is introduced into the upper horizontal injection wells. Preferably, the wells are disposed to maximize the combined effects of gravity drainage and sweep efficiency caused by a continuous fluid drive force so that a reduced number of wells can be used to efficiently delete the formation. The present invention can maximize, relative to prior methods, the difference between (1) the projected revenue from hydrocarbons produced from the formation by the method, and (2) the projected cost of forming and operating the wells in the formation from which to produce the hydrocarbons.

More particularly, the present invention provides a method of producing hydrocarbons from a subterranean formation, comprising: injecting a fluid through at least two upper horizontal wells out into the formation for moving hydrocarbons from the formation into at least one lower horizontal well through which the hydrocarbons are produced, wherein each lower horizontal well is spaced laterally and vertically below and between two respective upper horizontal wells; and producing hydrocarbons through the at least one lower horizontal well at a cumulative rate faster than the cumulative rate of the fluid injected into the upper horizontal wells.

In a more particular embodiment, the method of producing hydrocarbons from a subterranean formation comprises: forming at least two longitudinally spaced, laterally extending arrays of substantially parallel upper and lower horizontal wells in the formation so that within each array the upper horizontal wells are vertically and laterally spaced from the lower horizontal wells sufficient distances for enabling fluid flow pressure differentials to be maintained between the upper and lower horizontal wells and for enabling gravity drainage between the upper and lower horizontal wells and so that between each array there is sufficient distance for enabling each lower horizontal well to operate as a discrete production well; injecting, through the upper horizontal wells out into the formation, fluid which improves the mobility of hydrocarbons in the formation, including: establishing fluid flow pressure differentials between respective upper and lower horizontal wells; and moving improved mobility hydrocarbons from the formation into the lower horizontal wells both in response to the fluid flow pressure differentials and in response to gravity drainage; and producing hydrocarbons from the lower horizontal wells at a rate which is greater than the rate at which fluid is injected into the upper horizontal wells.

Therefore, from the foregoing, it is a general object of the present invention to provide a novel and improved method of producing hydrocarbons from a subterranean formation. Other and further objects, features and advantages of the present invention will be readily apparent to those skilled in the art when the following description of the preferred embodiments is read in conjunction with the accompanying drawings.

DETAILED DESCRIPTION OF PREFERRED EMBODIMENTS

As used herein, "formation" refers to a subterranean hydrocarbon-containing zone in which vertical and horizontal fluid communication can be established between the upper and lower horizontal wells used in the present invention. "Horizontal" as used herein with reference to wells encompasses deviated wells of the type known in the art by this term. "Point source-like breakthrough" as used herein refers to breakthrough of injected fluid from a length of a horizontal injection well near its end to a length of the closer end of the adjacent horizontal production well which represents more than a single point for breakthrough.

Figure 1:
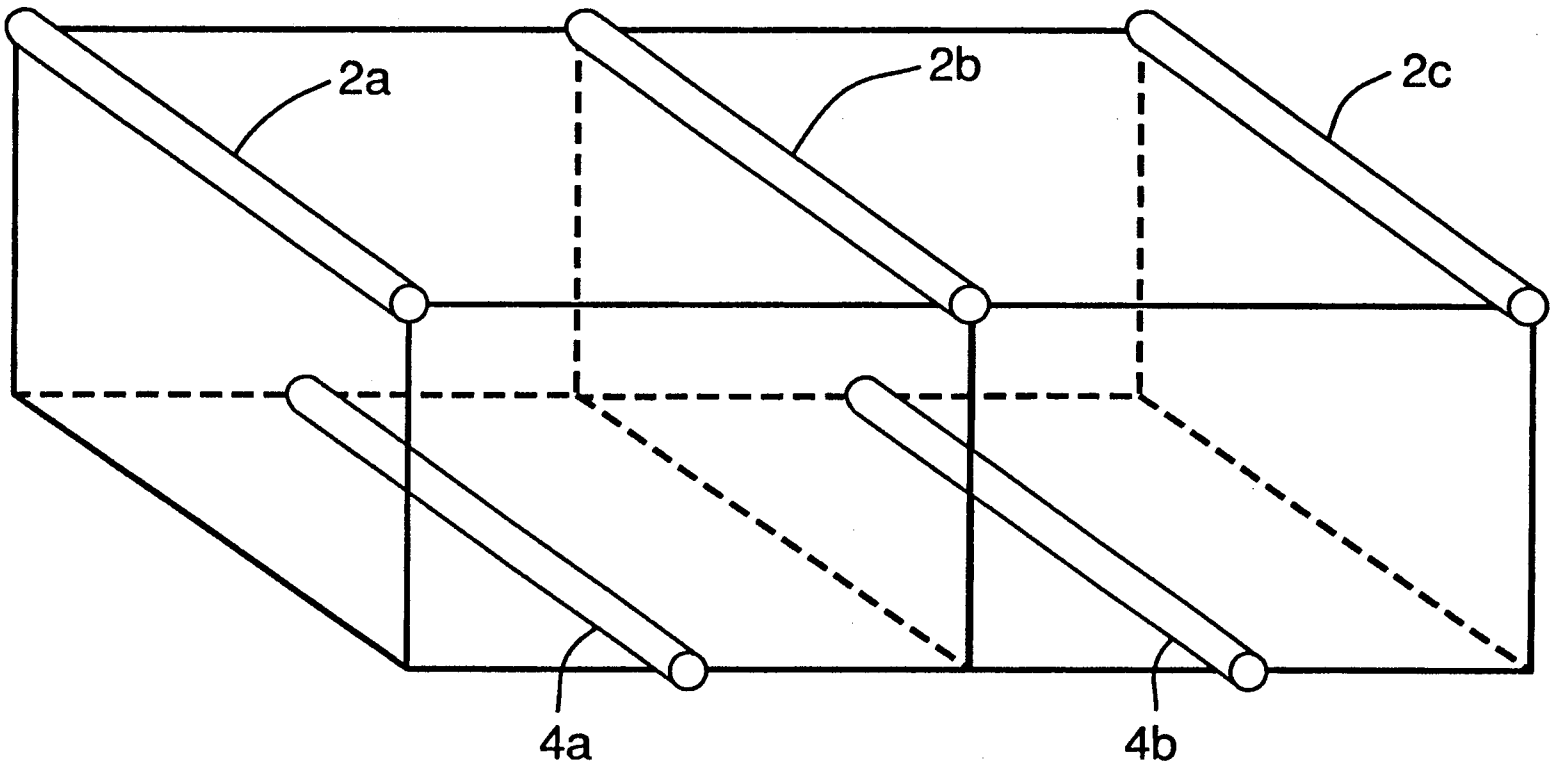
FIG. 1 is a schematic perspective view of an array of horizontal wells defined for use in the method of the present invention.

The method of the present invention uses an array of solely horizontal wells. The array includes at least two upper horizontal wells and at least one lower horizontal well staggered laterally and vertically below and between two upper horizontal wells. A plurality of such wells are shown in FIG. 1. Upper wells 2*a*, 2*b*, 2*c* are preferably substantially parallel and coplanar (i.e., horizontally aligned) with each other. Lower wells 4*a*, 4*b* are preferably substantially parallel and coplanar with each other. The lower wells 4 are also preferably substantially parallel to the upper wells 2. Lower well 4*a* is defined to be adjacent and associated with upper wells 2*a*, 2*b* as a functional set, and lower well 4*b* is similarly adjacent and associated with upper wells 2*b*, 2*c* as a second set of wells within the overall array depicted in FIG. 1. Thus, upper well 2*b* is common to both sets. Additional upper and lower wells can be similarly disposed in the array.

The wells 2, 4 are formed in a conventional manner using known techniques for drilling horizontal wells into a formation. See, for example, Butler, R. M., "The potential for horizontal wells for petroleum production," *J. of Canadian Petroleum Technology*, pages 39–47, vol. 28, no. 3 (May–June 1989). The size and other characteristics of the well and the completion thereof are dependent upon the particular job as known in the art. In a preferred embodiment, slotted or perforated liners are used in the wells.

The upper horizontal wells 2 are preferably near an upper boundary of the formation in which they are disposed, and the lower horizontal wells 4 are preferably near a lower boundary of the formation. As previously mentioned, these wells are substantially parallel to each other.

Each lower horizontal well 4 is spaced a distance from each of its respectively associated upper horizontal wells 2 (e.g., lower well 4*a* relative to each of upper wells 2*a*, 2*b*) for allowing fluid communication, and thus fluid drive to occur, between the two respective upper and lower wells. Preferably this spacing is the maximum such distance, thereby minimizing the number of horizontal wells needed to deplete the formation where they are located and thereby minimizing the horizontal well formation and operation costs. The spacing among the wells within a set is made to enhance the sweep efficiency and the width of a chamber formed by fluid injected through the implementation of the method of the present invention. The present invention is not limited to any specific dimensions because absolute spacing distances depend upon the nature of the formation in which the wells are formed; however, by way of example only, in a formation containing oil having an API gravity within the range of about 8°–12°, it is contemplated that a suitable vertical spacing between wells 2*a* and well 4*a*, for example, could be 18 meters and a suitable horizontal spacing could be 162 meters. With such a specific positioning of wells, a pressure differential of, for example, as much as about 8,000 kPa might be established between the respective upper and lower wells (e.g., upper well 2*a* and lower well 4*a*). These values do not limit other suitable distances or pressure differences which can be used in the present invention whether with oil of the aforementioned gravity or otherwise.

Using at least two of the upper horizontal wells 2 and at least one of the lower horizontal wells 4, the method of the present invention for producing hydrocarbons from a subterranean formation comprises concurrently flowing fluid through each of the upper horizontal wells out into the formation for moving hydrocarbons from the formation into the associated lower horizontal well through which the hydrocarbons are produced. Concurrently with these steps of flowing, the method comprises producing hydrocarbons through the lower horizontal well at a rate faster than the cumulative rate at which the fluid is flowed into the upper horizontal wells. The production rate is obtained in a conventional manner, such as by using a pump to lift fluid through the production well to the surface.

Figure 2:
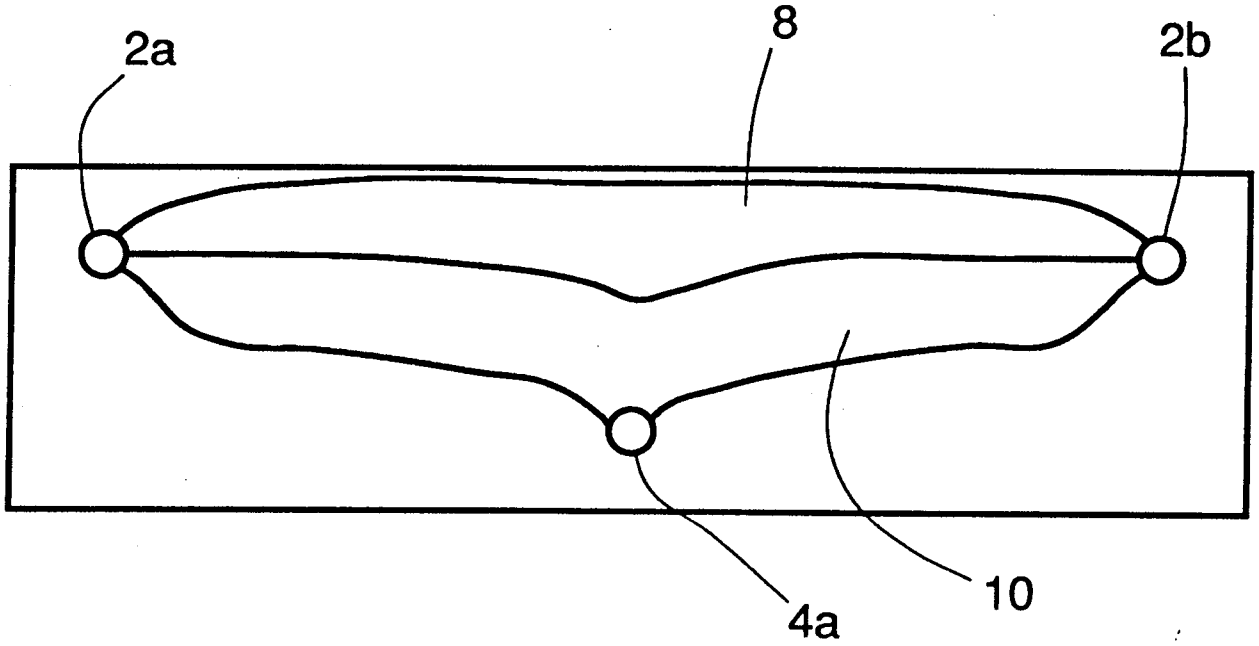
FIG. 2 is a schematic end view of a set of three wells from the array depicted in FIG. 1.
Figure 3:
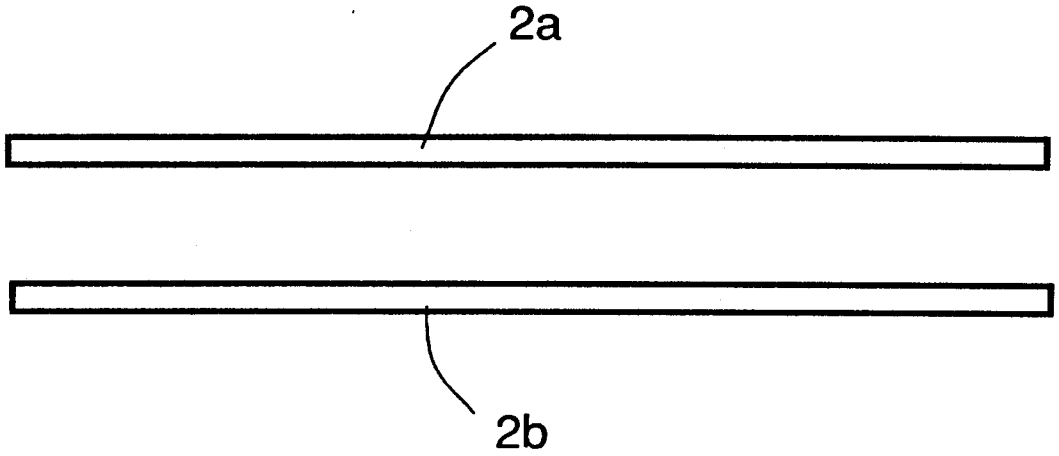
FIG. 3 is a schematic side view of the set of wells shown in FIG. 2.
Figure 4:
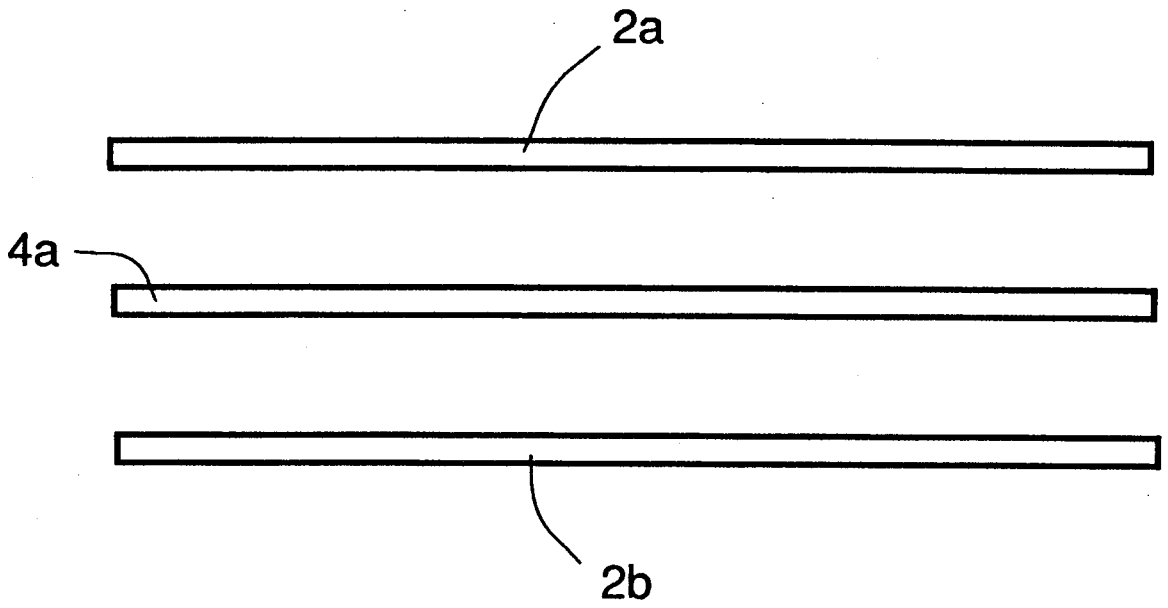
FIG. 4 is a schematic plan view of the set of wells shown in FIG. 2.
Figure 6:
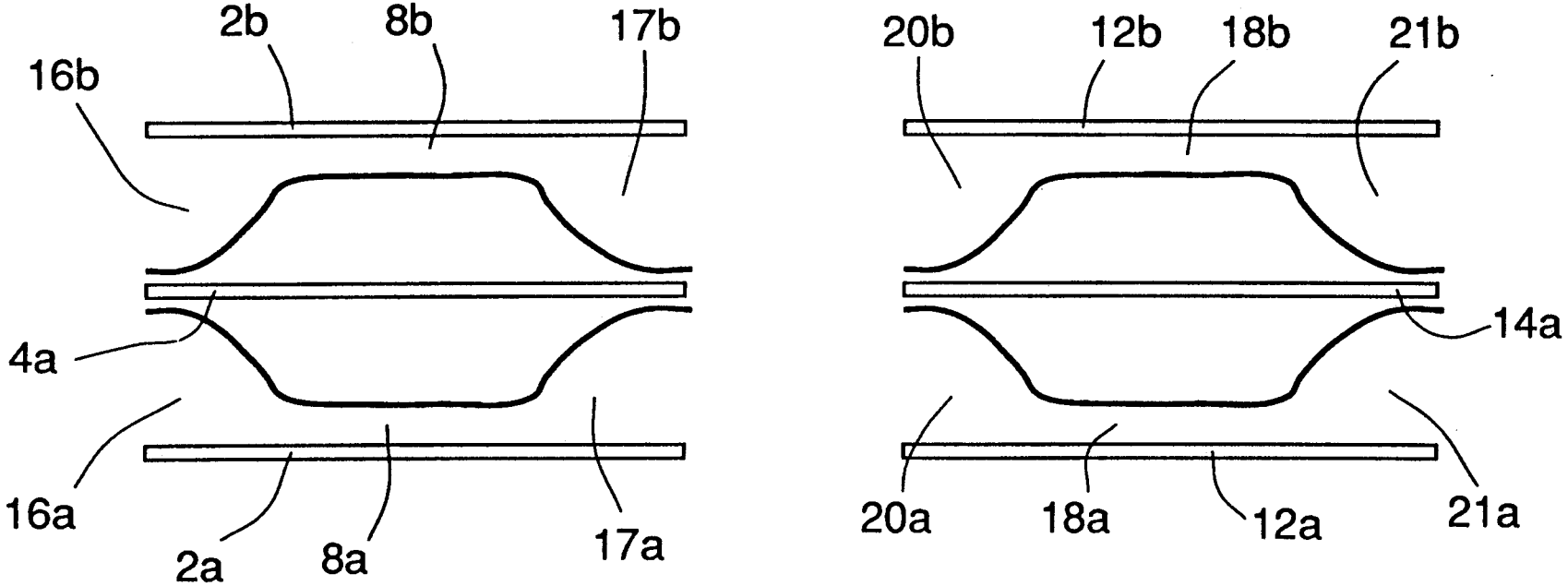
FIG. 6 is a schematic plan view of two longitudinally spaced sets of wells from the arrays shown in FIG. 5, including a schematic representation of the point source-like breakthrough effect on fluid chambers formed from the upper horizontal wells.

The long term result of performing these steps is schematically illustrated in FIG. 2, which shows an end view of upper wells 2*a*, 2*b* and lower well 4*a* in a formation 6. A volume or chamber 8 of the injected fluid has been created. This has formed over time as the injected fluid has migrated through the formation between and from the associated injection wells 2*a*, 2*b* and above the associated production well 4*a*. As such migration has occurred, hydrocarbons in the formation 6 have been driven by the fluid pressure and in response to gravity drainage through lower volume 10 toward the production well 4*a*. An earlier stage of the development of the chamber 8 is shown in FIG. 6 (a plan view) wherein injected fluid volumes 8*a*, 8*b* have evolved due to fluid injection into upper wells 2*a*, 2*b*, respectively. These volumes 8*a*, 8*b* will be further discussed hereinbelow.

The fluid is flowed into the one or more upper wells in a conventional manner, such as by injecting in a manner known in the art. The fluid is one which improves the ability of hydrocarbons to flow in the formation so that they more readily flow both in response to gravity and a driving force provided by the injected fluid. Such improved mobility can be by way of heating, wherein the injected fluid has a temperature greater than the temperature of hydrocarbons in the formation so that the fluid heats hydrocarbons in the formation. A particularly suitable heated fluid is steam having any suitable quality and additives as needed. Other fluids can, however, be used. Noncondensable gas, condensible (miscible) gas or a combination of such gases can be used. In limited cases, liquid fluids can also be used if they are less dense than the oil, but gaseous fluids (particularly steam) are presently preferred. Examples of other specific substances which can be used include carbon dioxide, nitrogen, propane and methane as known in the art. Whatever fluid id used, it is preferably injected into the formation below the formation fracture pressure.

When a selected fluid is flowed into the formation through the upper horizontal wells 2, fluid flow communication and pressure differentials are established within respective sets of the upper and lower horizontal wells. That is, within each set of upper and lower wells, there is a pressure differential between each upper well and the associated lower well. With respect to the array shown in FIG. 1, the pressure differentials referred to are those created between wells 2*a*, 4*a*; 2*b*, 4*a*; 2*b*, 4*b*; 2*c*, 4*b*. The pressure differentials should be sufficient to provide a fluid drive force; therefore, hydrocarbons whose mobility is improved in response to the flowing fluid move from the formation into the lower horizontal wells both in response to the established fluid flow pressure differentials and in response to gravity drainage.

The particular fluid flow pressure differentials created between respective sets of the upper and lower horizontal wells are a function of the rate of fluid injection and the rate of fluid production. As previously described, and of particular significance, the method of the present invention produces at a cumulative rate which is greater than the cumulative injection rate. It is contemplated that the production rate being greater than the injection rate segregates the different phases of materials in the formation better. That is, it is contemplated that by producing at a greater rate, the resultant pressure in the formation tends to maintain an injected gaseous fluid in its gaseous state. If steam is injected, for example, it is contemplated that the greater production rate enables more steam to remain gaseous rather than to condense to water. Although some water condensation occurs at the interface between the steam and the liquid hydrocarbon as known in the art, an overabundance of condensation which could retard the production of the hydrocarbons is prevented by the higher production rate. In a preferred embodiment, the production rate is approximately two times the injection rate. The rates referred to are the total or cumulative rates for all the wells on injection and production.

Over time, the greater production rate tends to draw the injected fluid between two upper wells downward toward the associated lower production well. Breakthrough occurs when the injected fluid enters the production well and is produced along with the hydrocarbons from the formation. At this point, the production and injection rates are preferably adjusted to reach an equilibrium wherein the liquid level is just above the production well.

In the case of a heated gas being injected into the formation to migrate through the chamber 8, a limit of effectiveness can be reached when sufficient heat from the injected fluid is lost to the overburden above the upper boundary on the formation 6. Although such a point can be reached in the present invention, the combination of the spacing of the wells and the production rate is such that production can be continued with a combination of gaseous fluid and any condensed liquid which results.

To enable fluid to be injected through the upper wells into the formation, mobile fluid communication in the reservoir must exist. If such communication does not naturally exist, it needs to be created. The creation of communication can be by any suitable known technique. If the hydrocarbons in the formation are mobile enough, primary production techniques, such as pumping or using natural forces within the formation, can be used. If a mobile water zone exists, it can be used. If necessary, a secondary of other recovery technique can be used, such as cyclic steaming. Such techniques can be applied using either the upper horizontal wells 2 or the lower horizontal wells 4 or any combination of them as desired. By way of example, in a formation having characteristics as specified in the table set forth hereinbelow, it is contemplated that all of the wells 2, 4 can be placed on primary production for some period of time prior to performing the remaining steps of the method of the present invention. That is, there are hydrocarbons in such a formation which are mobile at preexisting formation conditions so that they can be produced to some extent prior to flowing fluids through the injection wells 2 in the manner described above. Such primary production improves the injectivity of the formation by lowering the reservoir pressure. Such primary production is also highly desirable in that it provides a relatively low risk means of enhancing the economic payout of the wells before the relatively high cost of fluid injection is incurred.

Injectivity can also be provided through zones of relatively higher water saturation within the formation. For steam injection, the formation water can be used advantageously as a conduit for establishing communication across the formation because of the mobility of steam through water even where the hydrocarbons have insufficient solution gas to produce under primary energy. The presence of a gas cap can be similarly used to establish injectivity or communication of the injected fluid through the formation.

Figure 5:
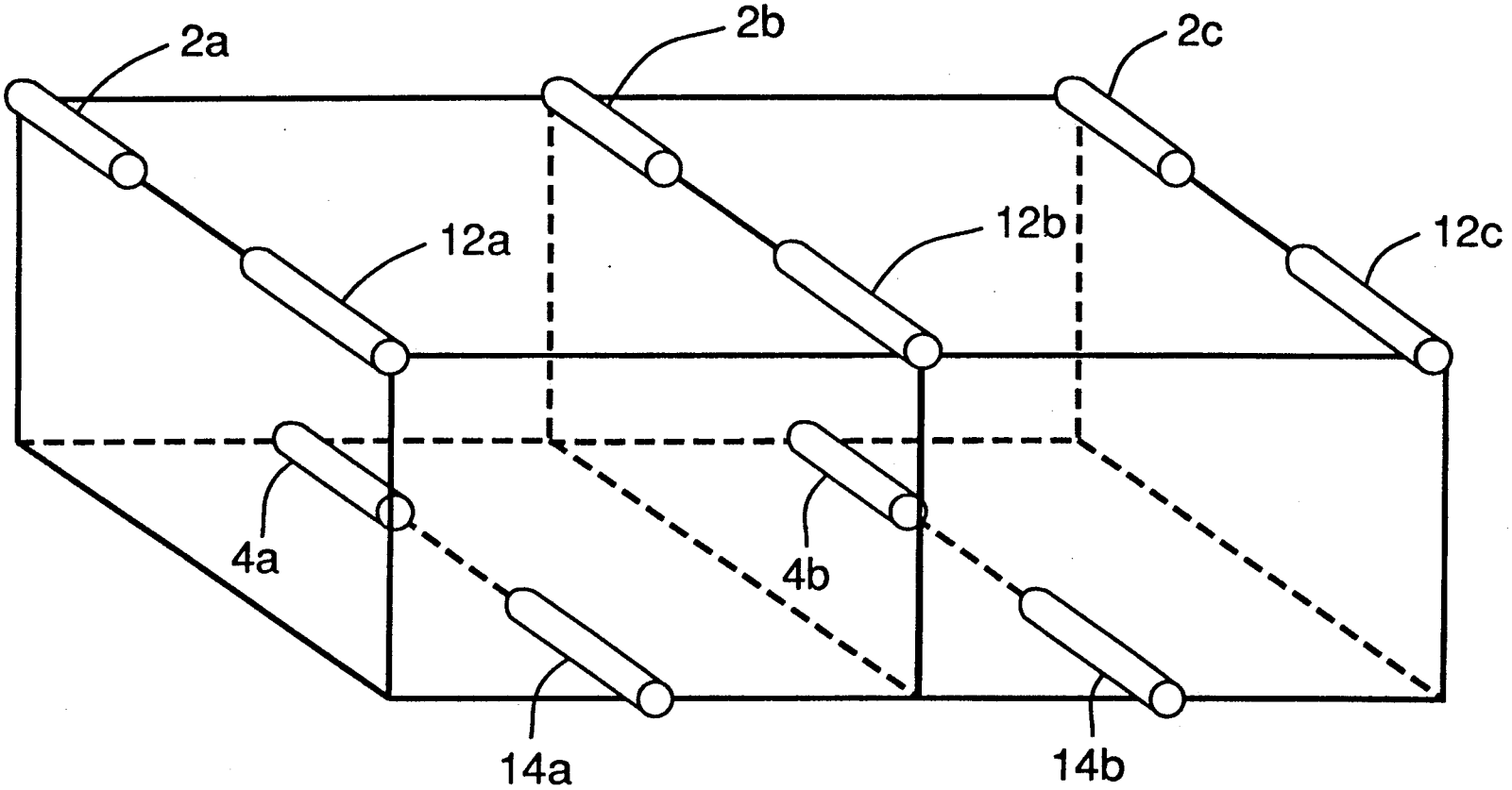
FIG. 5 is a schematic perspective view of two arrays of horizontal wells defined for use in the method of the present invention.

The present invention also contemplates the use of multiple arrays of horizontal wells spaced longitudinally from each other. This is illustrated in FIG. 5 wherein a second array comprising upper horizontal wells 12*a*, 12*b*, 12*c* and lower horizontal wells 14*a*, 14*b* are longitudinally spaced from wells 2*a*, 2*b*, 2*c*, 4*a*, 4*b*, respectively (although wells of the two arrays are also shown coaxially related, it is contemplated that this may not be required). The arrays are spaced sufficient distances for enabling each lower horizontal well to provide a point source-like breakthrough to an injected fluid. That is, spacing is to be such that each lower horizontal well functions as a discrete production well. A preferred spacing for a formation as specifically referred to herein is within the range between about 100 meters to about 200 meters; however, the present invention is not limited to such specific range of spacing. The wells of the second, and any additional, array are utilized in the same manner described hereinabove with regard to the first array.

Providing sufficient spacing so that each lower horizontal well functions as a discrete production well accelerates the creation of the respective chambers of injected fluid. This allows peak production to occur sooner and still allow an excellent return over time (for example, modeling has shown a return within the range between about 50%-60% of the original oil in place; however, the present invention is not limited to, nor does it guarantee, any specific return or rate of return). Referring to the set of wells 2*a*, 2*b*, 4*a* of the first array, for example, such separation between arrays allows the chamber 8 (and others like it) to be formed for its respective set of wells. Chamber 8 is formed ultimately from the development and growth of the volumes 8*a*, 8*b* illustrated in the plan view of FIG. 6. The desired longitudinal spacing between the adjacent arrays particularly allows the volumes 8*a*, 8*b* to growth with the enlarged end portions 16*a*, 17*a* and 16*b*, 17*b*, respectively, schematically depicted in FIG. 6. These enlarged ends occur due to a combination of pressure, volume and temperature effects which occur due to the different pressure profiles developed at the ends of both the upper injection wells and the lower production wells so that point source-like breakthrough occurs along the production well near each end. The corresponding volumes with regard to the second array set of wells 12*a*, 12*b*, 14*a* shown in FIG. 6 are identified by the reference numerals 18*a*, 18*b* and their enlarged end portions are identified by the reference numerals 20*a*, 21 and 20*b*, 21*b*, respectively. There is lateral or radial migration of the injected fluid around the entire circumference of each injection well 2, particularly if the injection well is associated with another production well; however, FIG. 6 illustrates that which is most pertinent to the sets of wells shown therein.

The growth of the volumes 8*a*, 8*b* and 18*a*, 18*b*, etc., toward intersection to form their respective chambers 8, 18, etc., occurs in response to the fluid drive force imparted by the injecting steps of the present invention. This is contemplated to occur over several months or years in such heavy oil formations as specifically referred to herein. Upon a chamber being formed continuously between adjacent upper injection wells, fluid drive continues to enlarge the chamber until it reaches and breaks through into the associated lower production well as previously described. This follows the peak production rate being obtained from the production well. After breakthrough, the injection and production are controlled preferably to achieve the previously described equilibrium. This entire process is preferably provided so that hydrocarbons in the affected formation move in response to both fluid drive and gravity drainage throughout the entire process.

A numerical model study using the THERM numerical simulator commercially available from Scientific Software Intercomp was conducted to evaluate four different well configurations for a formation having characteristics set forth in the table below.

The four patterns studied were: (1) steam assisted gravity drainage (SAGD) pattern (a pair of closely spaced horizontal wells, one aligned vertically over another) (see the aforementioned references regarding parallel horizontal injection and production wells vertically aligned a few meters apart); (2) modified heated annulus steam drive (modified HASDrive) pattern (a vertical production well and a horizontal "heater" well drilled near the bottom of the pay) (similar to the aforementioned Anderson patent); (3) modified "Sceptre" pattern (four vertical injection wells and a horizontal production well); (4) pattern of the present invention (lower production horizontal well laterally and vertically spaced from upper injection horizontal well).

The reservoir description for the study was derived from log and core data available form actual wells. Seven geological layers were grouped into two rock types. An oil viscosity variation with depth was input as described in Erno, B. P., Chriest, J. R., and Wilson, R. C., "Depth Related Oil Viscosity Variation in Canadian Heavy Oil Reservoirs," 40th annual meeting of the Petroleum Society of CIM, May 1989, and observed in viscosity measurements from two wells. The relative permeability data (also from core plugs from a pilot well) were refined to eliminate sharp changes in the gas permeability near the critical gas saturation. Laboratory tests were run to obtain the residual oil saturation to steam. The time step control parameters for the simulations of the four configurations needed to be reduced significantly from the default values in the THERM numerical simulator to eliminate material balance errors and to ensure the completion of the runs. It was assumed that some amount of heavy oil could be produced by primary depletion for one year and that steam could be injected at a desired rate following the primary depletion. Particular formation characteristics are listed in the following table:

| | |
|---|---|
| Avg. net thickness, (m) | 18.0 |
| Avg. Permeability, (darcy) | 4-5 |
| Temperature, (°C.) | 21 |
| Oil Gravity, (°API) | 8-12 |
| Oil Viscosity (at 23° C., mPa · S = cp Dead Oil) | 8400 to 23000 + |
| Oil Saturation (% PV) | 66-72 |
| Porosity, (%) | 35-36 |
| Pressure, (kPa) | 2770 |
| G.O.R., ($m^3/m^3$) | 9.4 |

Figure 7:
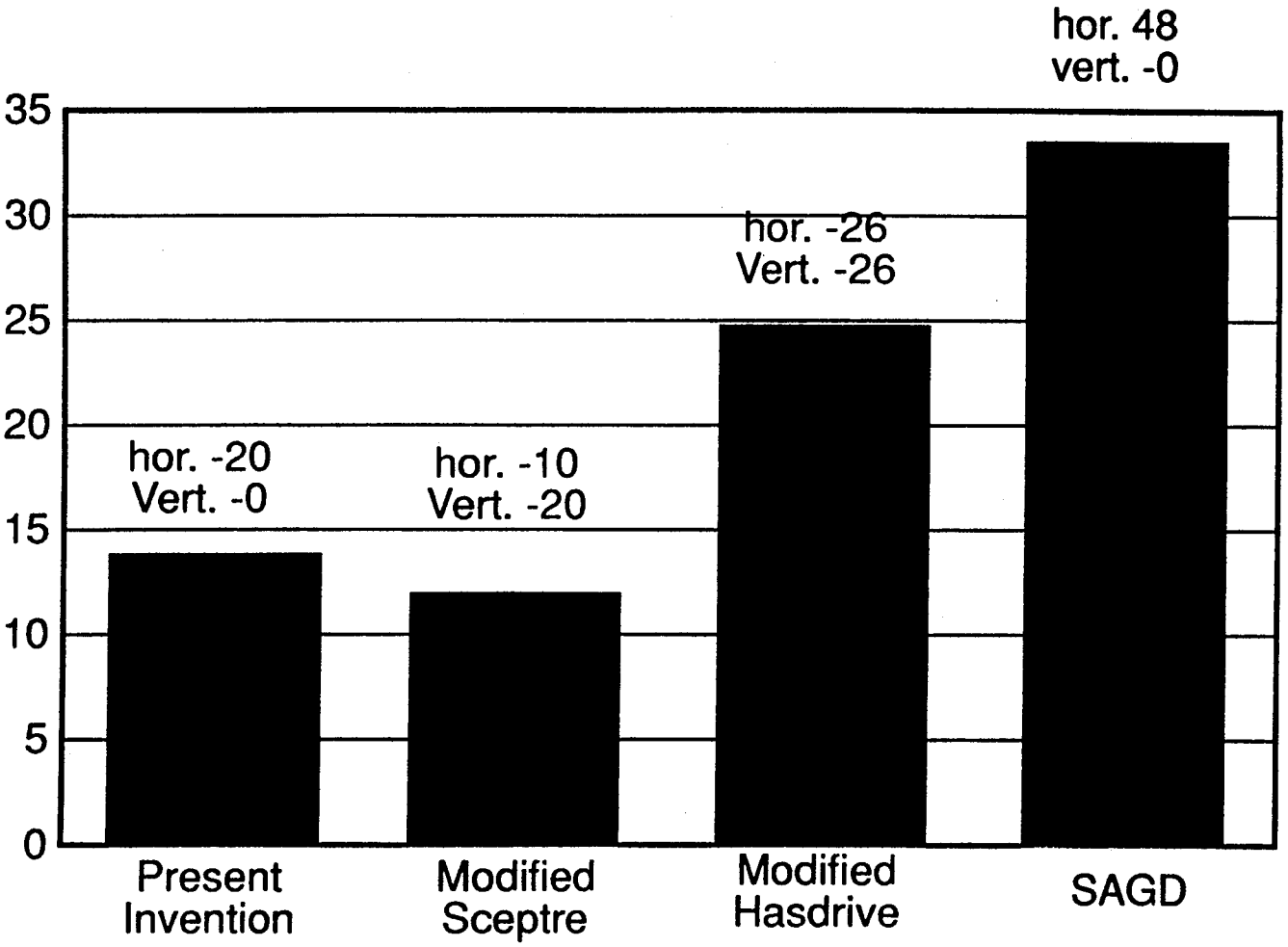
FIG. 7 is a chart showing projected well formation capital costs for four different well configurations.

A comparison of the economics of the four patterns was made on the basis of the development of one section of land. Using the spacings obtained from the model studies, the number of wells required to develop a section of land was determined. FIG. 7 shows the total well costs in each case assuming that a horizontal well costs $700,000 and a vertical well costs $250,000. The well costs were the highest for the SAGD and Modified HASDrive patterns because of an inability to drain large areas laterally from the horizontal wells. These processes required additional wells to effectively drain an entire section. The well costs were the least for the modified Sceptre and present invention patterns. Operating costs for each of the process configurations were also included in the economics.

Figure 8:
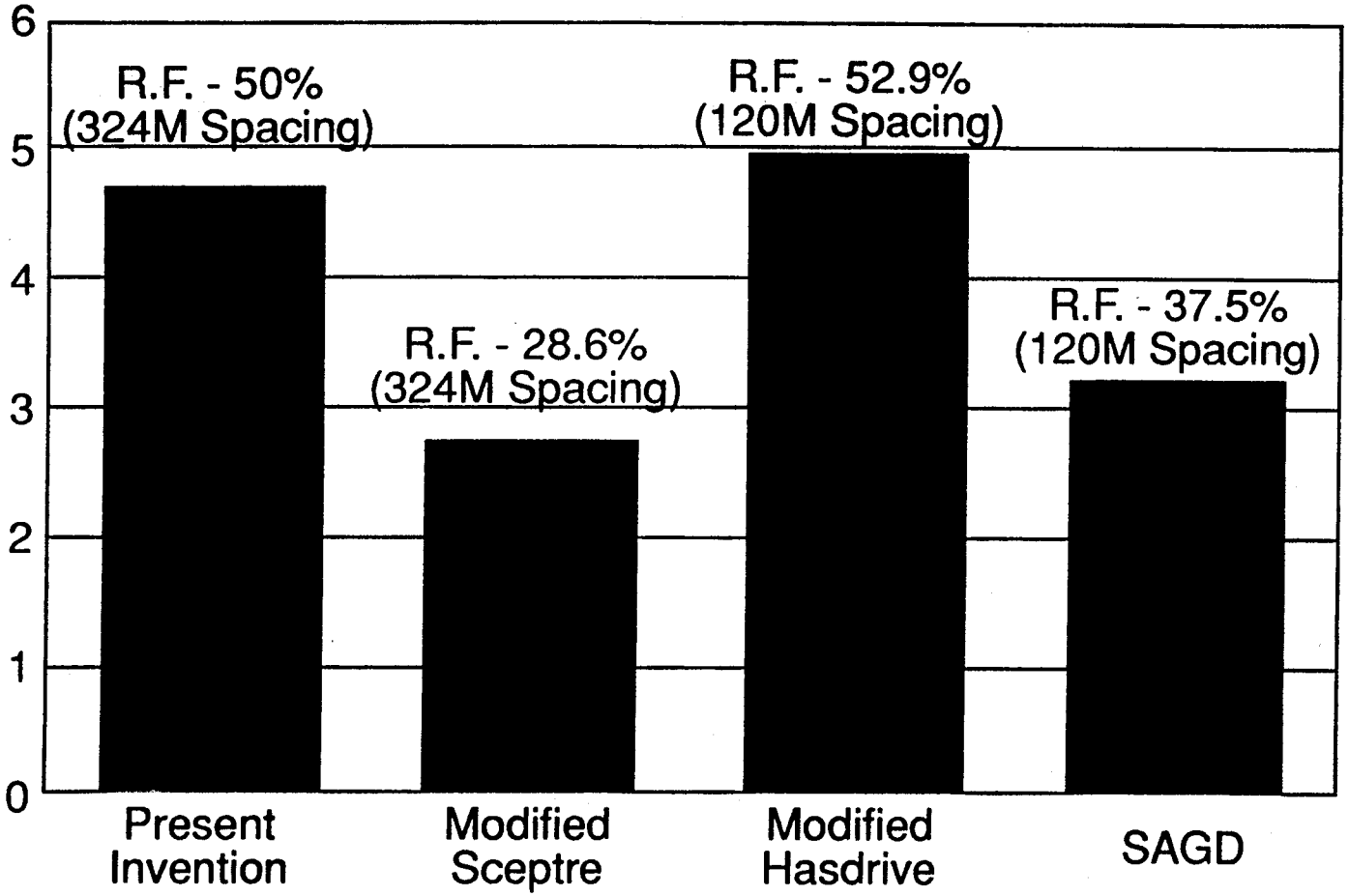
FIG. 8 is a chart showing modeled cumulative oil recovery and recovery factors for the four well configurations.
Figure 9:
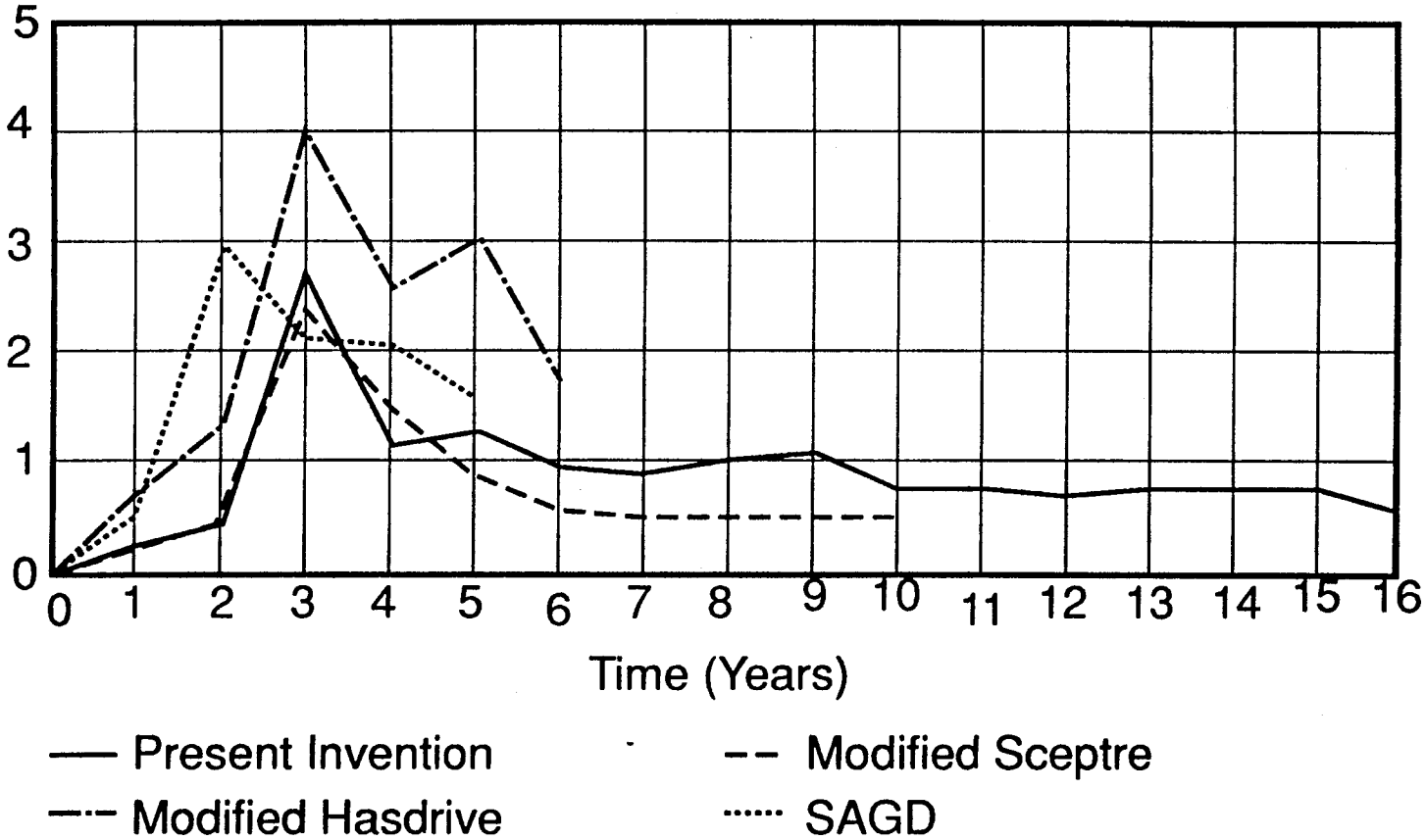
FIG. 9 is a chart showing modeled oil production rates over time for the four well configurations.

FIG. 8 shows the total cumulative oil production and the recovery percent of the original oil in place for each process. The present invention and modified HASDrive processes had the highest recovery factors (approximately 50-55%) while the modified Sceptre and SAGD processes recovered the least (approximately 30-40%). FIG. 9 shows the total oil production rate from a theoretical section of land developed by each pattern process.

The following conclusions were drawn from the study of the four configurations:

1. Based on lower well costs and higher cumulative oil production, the present invention proved to be the most economically attractive process of the four that were evaluated.

2. The model predicted that after one year of primary production enough communication is created in the reservoir to inject up to 375 cubic meters per day ($m^3/d$) of steam in a single horizontal well. The same amount of steam can also be injected in the reservoir using two vertical wells (modified Sceptre process).

3. It is possible to utilize a larger well spacing in the present invention and modified Sceptre processes since the region between the injector and the producer is heated by steam within a reasonable period of time (2 to 3 years). In the modified HASDrive and SAGD processes, the production responses result from the heated zone growing away from the injector-producer path. The growth of this zone decreases with time.

4. The operating practice of producing hydrocarbons from the lower wells at a rate which is greater than the rate at which fluid is flowed into the upper horizontal wells, on a cumulative basis, was crucial to the successful application of the present invention.

5. The modified HASDrive and present invention processes resulted in the highest recovery factors. The rates of recovery and the ultimate recovery were the dominating revenue factors in the economic analysis.

6. The cost of drilling and completing the wells was a dominant cost factor in the economic analysis. The cost of drilling a 500 meter horizontal well used in the study was estimated to be nearly three times the cost of drilling a vertical well. The number of wells is a strong factor favoring the patterns that can utilize a larger well spacing.

The pattern of the present invention provided the best overall economic performance. Therefore, the present invention provides a method of economically depleting a formation to maximize the difference between the projected revenue from hydrocarbons produced from the formation by the method and a projected cost of forming and operating wells in the formation through which to produce the hydrocarbons.

Although the foregoing has been described with specific reference to recovering heavy, viscous oil, the present invention can be used for recovering other hydrocarbons from a wide range of formation conditions. Regardless of the type of hydrocarbon to be produced or the formation conditions, it is an object of the present invention to utilize the combined effects of gravity drainage and sweep efficiency to reduce the number of wells required to efficiently deplete the formation.

In the preferred embodiment utilizing steam, this is accomplished through an array of sets of two upper horizontal injection wells and one lower horizontal production well, wherein the respective two upper wells of a set located higher in the formation are used to inject steam to begin driving oil across the reservoir and to ultimately establish a steam chamber above the respective lower horizontal production well which is placed low in the formation below and between the associated two upper wells. The high/low aspects of the configuration promote the growth of the steam chamber due to gravity segregation or drainage. The lateral separation encourages the steam chamber to grow to a larger horizontal width.

Whereas other techniques may rely upon the relatively limited process of conductive heating, or the relatively poor ultimate sweep of point source injection with vertical wells, or the uncertainty of fracture placement, the present invention utilizes solely horizontal wells spaced sufficient distances to obtain both injection drive forces and gravity drainage for mobilizing and moving hydrocarbons into production wells. The fewer number of wells needed due to the larger spacing in combination with the production achieved utilizing the method make the method of the present invention an economic means of recovering oil and other hydrocarbons from subterranean formations.

Thus the present invention is well adapted to carry out the objects and attain the ends and advantages mentioned above as well as those inherent therein. While preferred embodiments of the invention have been described for the purpose of this disclosure, changes in the performance of steps can be made by those skilled in the art, which changes are encompassed within the spirit of this invention as defined by the appended claims.

What is claimed is:

1. A method of production hydrocarbons from a subterranean formation, comprising:

injecting a fluid through at least two upper horizontal wells out into the formation for moving hydrocarbons from the formation into at least one lower horizontal well through which the hydrocarbons are produced, wherein each lower horizontal well is spaced laterally and vertically below and between two respective upper horizontal wells and wherein the upper and lower horizontal wells are substantially parallel; and producing hydrocarbons through the at least one lower horizontal well at a cumulative rate faster than the cumulative rate of the fluid injected into the upper horizontal wells.

2. A method as defined in claim 1, further comprising injecting a fluid and producing hydrocarbons as defined in claim 1 but with additional upper and lower horizontal wells longitudinally spaced from the first-mentioned upper and lower horizontal wells so that each of the lower horizontal wells operates as a discrete production well.

3. A method as defined in claim 1, wherein said fluid is steam and is injected through the upper horizontal wells for heating hydrocarbons in the formation and for providing a driving force so that heated hydrocarbons move to the lower horizontal well in combined response to gravity drainage and the driving force.

4. A method as defined in claim 1, wherein the fluid has a temperature greater than the temperature of hydrocarbons in the formation for heating hydrocarbons in the formation and driving heated hydrocarbons toward the lower horizontal well in response to pressure differentials between the upper horizontal wells and the lower horizontal well.

5. A method as defined in claim 1, wherein the fluid improves the ability of hydrocarbons to flow in the formation so that the hydrocarbons more readily flow in response to gravity and a driving force provided by the flowing fluid.

6. A method as defined in claim 1, further comprising producing from the upper horizontal wells hydrocarbons which are mobile at preexisting formation conditions prior to injecting the fluid.

7. A method as defined in claim 1, wherein each of the upper horizontal wells is spaced respectively from the lower horizontal well at a maximum distance allowing fluid communication between the wells.

8. A method as defined in claim 1, wherein the upper horizontal wells are near an upper boundary of the formation and wherein the lower horizontal well is near a lower boundary of the formation.

9. A method of producing hydrocarbons from a subterranean formation, comprising:

forming in the formation an array of injection and production wells, which array includes a plurality of substantially parallel upper horizontal wells and a plurality of substantially parallel lower horizontal wells, wherein each of the lower horizontal wells is disposed between and below two upper horizontal wells a distance allowing fluid communication between adjacent upper and lower horizontal wells;

creating communication in the formation; and injecting a fluid through upper horizontal wells at a cumulative injection rate and producing oil from respective adjacent lower horizontal wells at a cumulative production rate for establishing a fluid injection pressure differential between the upper horizontal wells through which the fluid is injected and the respective adjacent lower horizontal wells, wherein the cumulative production rate is greater than the cumulative injection rate.

10. A method as defined in claim 9, wherein the fluid injected is steam and wherein the cumulative production rate is at least about two times the cumulative injection rate.

11. A method as defined in claim 9, further comprising forming another array of injection and production wells, which another array includes a plurality of upper horizontal wells and a plurality of lower horizontal wells spaced from the upper and lower horizontal wells of the first-mentioned array so that each of the lower horizontal wells operates as a discrete production well.

12. A method as defined in claim 9, wherein the upper horizontal wells are near an upper boundary of the formation and wherein the lower horizontal wells are near a lower boundary of the formation.

13. A method of producing hydrocarbons from a subterranean formation, comprising:

forming at least two longitudinally spaced, laterally extending arrays of substantially parallel upper and lower horizontal wells in the formation so that within each array the upper horizontal wells are vertically and laterally spaced from the lower horizontal wells sufficient distances for enabling fluid flow pressure differentials to be maintained between the upper and lower horizontal wells and for enabling gravity drainage between the upper and lower horizontal wells and so that between each array there is sufficient distance for enabling each lower horizontal well to operate as a discrete production well;

injecting, through the upper horizontal wells out into the formation, fluid which improves the mobility of hydrocarbons in the formation, including:

establishing fluid flow pressure differentials between respective upper and lower horizontal wells; and moving improved mobility hydrocarbons from the formation into the lower horizontal wells both in response to the fluid flow pressure differentials and in response to gravity drainage; and producing hydrocarbons from the lower horizontal wells at a rate which is greater than the rate at which fluid is injected into the upper horizontal wells.

14. A method as defined in claim 13, wherein the upper horizontal wells of each array are disposed near the top of the formation and wherein the lower horizontal wells of each array are disposed near the bottom of the formation.

15. A method as defined in claim 13, further comprising producing hydrocarbons from the upper horizontal wells before initiating the injection of the fluid.

16. A method as defined in claim 13, wherein said fluid is steam and is injected through the upper horizontal wells into the formation so that the steam migrates through the formation between the upper horizontal wells to form a continuous steam chamber between the upper horizontal wells and above the respective lower horizontal wells.

17. A method as defined in claim 13, wherein:

the upper horizontal wells are near an upper boundary of the formation and the lower horizontal wells are near a lower boundary of the formation;

hydrocarbons which are mobile within the formation at preexisting formation conditions are produced from the upper horizontal wells; and said fluid is steam and is injected into the upper horizontal wells for heating hydrocarbons in the formation and driving the heated hydrocarbons toward the lower horizontal wells in response to the pressure differentials established between the upper horizontal wells and the lower horizontal wells while the steam is injected, wherein the steam migrates from the upper horizontal wells above the lower horizontal wells of each array and hydrocarbons are moved into the lower horizontal wells in combined response to steam drive and gravity drainage forces.

* * * * *